United States Patent [19]

Wunsche

[11] 4,455,017

[45] Jun. 19, 1984

[54] FORCED COOLING PANEL FOR LINING A METALLURGICAL FURNACE

[75] Inventor: Edgar R. Wunsche, Oshawa, Canada

[73] Assignee: Empco (Canada) Ltd., Oshawa, Canada

[21] Appl. No.: 438,317

[22] Filed: Nov. 1, 1982

[51] Int. Cl.[3] ..... F27D 15/02

[52] U.S. Cl. ..... 266/190; 266/193; 266/241; 432/77

[58] Field of Search ..... 373/76; 266/190, 241, 266/193, 280, 286; 432/77, 233, 238

[56] References Cited

U.S. PATENT DOCUMENTS

| | | | |
|---|---|---|---|
| 4,207,060 | 6/1980 | Zangs | 266/241 |
| 4,351,055 | 9/1982 | Bick et al. | 373/76 |

FOREIGN PATENT DOCUMENTS

| | | | |
|---|---|---|---|
| 554050 | 1/1957 | Belgium | 432/238 |
| 4614 | 10/1979 | Fed. Rep. of Germany | 266/241 |
| 8100758 | 3/1981 | Fed. Rep. of Germany | 373/76 |
| 604872 | 4/1978 | U.S.S.R. | 266/190 |

*Primary Examiner*—L. Dewayne Rutledge
*Assistant Examiner*—S. Kastler
*Attorney, Agent, or Firm*—Swabey, Mitchell, Houle, Marcoux & Sher

[57] ABSTRACT

A forced cooling, metallic, refractory coated, high strength, modular, extreme heat withstanding, long life lining element for partial or total lining of metallurgical furnaces above the hot metal and slag levels, in particular melting Electric Arc and Plasma Arc Furnaces, with automatic coolant flow control, is disclosed. In accordance with the invention the forced cooling lining element consists of at least three (3) seamless, heavy wall boiler type pipes, arranged in generally parallel, eccentrically spaced non-contacting relation, with circular spacers, neighboring pipes being interconnected by welded mitres and elbows to create series or series-parallel serpentine and zig-zag structural pattern. The hot face of the pipes is provided with protective refractory anchoring system consisting of multitude coaxially and diagonally to the pipes arranged intermittent protuberances. Positive retention of the protective refractory-slag layer is controlled by means of heat extracting liquid coolant, flowing at high velocities and high pressure through the pipes structural pattern. The discharge flow of the liquid coolant such as water is controlled by an automatic flow control device which is an integral and constituent component of the element.

23 Claims, 10 Drawing Figures

FORCED COOLING PANEL FOR LINING A METALLURGICAL FURNACE

BACKGROUND OF THE INVENTION (i) Field of the Invention

This invention relates to heat withstanding cooling elements for lining of metallurgical furnaces above the hot metal and slag levels, in particular the steel scrap and/or sponge iron melting Electric Arc and Plasma Arc Furnaces.

(ii) Description of the Prior Art

Flexibility of operation, high productivity rates per unit and overall better production economy of the melting Electric Arc Furnaces for iron and steelmaking, has resulted in world wide rapid growth of the number and size of this type of furnace. Recently Electric Arc Furnaces have gained even more importance, when becoming the main units for large scale steel production by further enlarging their capacities and particularly by increasing the power input levels. More frequently the increased power input levels are achieved not only by higher electrical power loading, but also with the help of additional energy sources such as oxy-fuel burners and most recently Plasma Arc burners. As a result of the increased power input levels the life of standard interior wall refractory lining above the hot metal zone has become extremely short. As a consequence of the short life of interior wall refractory, limited to approximately 100–150 heats, furnace operation has been frequently interrupted for the removing of the worn out, and installation of the new, lining. The time delay necessary for replacement of the refractory lining had an obvious negative effect on the overall furnace operating productivity and costs. Development and practical use of water cooled elements for interior walls as a replacement for standard refractory walls, above the hot metal zone, has reduced the non-productive time delays and has significantly improved the operating economy of the Electric Arc Furnace. Several design types of furnace interior wall water cooled elements have already been made available to the steel industry.

Some of the known designs of the box type water cooled elements (U.S. Pat. Nos. 3,940,552 and 4,119,792) are made from plain metallic plates, with added components which protrude from the elements hot face for better slag retention. A disadvantage of the box type water cooled elements is that, due to the large cross-section of the cooling water passages, the desirable high exposure of the hot face plate of the element to the cooling water flow is reduced. Together with low cooling water flow velocity, inadequately directed water flow creates vortexes and dead flow spaces in the passage corners with a consequent water vapor and air-bubble development and concentration, causing frequent and significant localized heat transfer reduction. This in effect could lead to destruction of the water cooled element, resulting in water leakage and necessitating replacement of the element. Another disadvantage of the box type elements, made from plain metallic plates is that the applied slag retaining system, consisting of multitudes of specially shaped components of separate design and protruding from the hot face of the element, are vulnerable to damage and burn-off during normal operation of the furnace. These components must be often renovated, since the hot face plain plate of the box type element has insufficient slag retaining ability. An additional disadvantage of the box type water cooled element made from plain metal plate of restrictd thickness is the low structural strength inherent in the design, which does not allow high pressure cooling water operation, necessary for possible heat recuperation from the used cooling water.

Other known designs of box type water cooled elements (U.S. Pat. Nos. 4,097,679 and 4,122,295) are made from combination of plain metallic plates and cast or heavy wall hot face plate in which for better slag retaining the cast hot face plate has precast grooves or ribs, and in which the heavy wall plate has grooves or ribs created by machining. Besides having disadvantages similar to the box type elements made from plain metallic plates only, the combination box type water cooled elements are more vulnerable to cracking of the heavy wall hot face plate. Furthermore the grooves or ribs created by precasting or machining and protruding from the hot face of the element are exposed to extremely high thermal stresses in the area of their roots at the transition into the body of the hot face plate.

Due to the rapid operational temperature changes of the furnace interior, the protruding components break off from the hot face plate. In addition to the fact that the hot face plate of the element becomes plain and therefore unable to efficiently retain a protective slag layer, the area of the broken-off ribs is destroyed resulting in further cracks of the hot face plate and a variety of consequential damages.

Water cooled elements constructed as solid cast block-slabs, with internally arranged water cooling pipes (U.S. Pat. No. 3,843,106) have the disadvantage, that their substantial wall thickness and weight, necessitates strengthening of the furnace shell resulting in overall weight increase. Inadequate heat dissipation from the smooth hot face of the element, because of the wall thickness, further enhanced by rapid changes of furnace operational temperature, prevents the desired build-up of a protective slag layer. This leads to destruction of the monolithic cast body made from cast iron, copper or other metal. Exposed water cooling pipes with low thermal inertia eventually completely separate from the main cast block body, enforcing premature replacement of the element. An additional disadvantage of cast in pipes is the gap between the pipes and cast block, which results from the casting procedure and creates a thermal barrier reducing even more the heat extracting ability of the element.

The known design of tubular, coil type water cooled elements with neighbouring tubes of the coil arranged in a contacting relation with tube center lines in one plane (U.S. Pat. No. 4,207,060) have a significant disadvantage in that they have insufficient ability to permanently retain protective refractory material applied or deposited prior to operational use, or slag deposited on the element hot face by splashing during furnace operation.

This disadvantage exists even in the case where the smooth surface of the hot face of the tubes is provided with a plurality of projections or burls. The lack of satisfactory permanent retention of the initially, deposited refractory or splashed on slag on the hot face in this type of water cooled element rests, in principle, in the physical phenomenon of high shrinkage gradient of the slag layer body, which is almost directly proportional to its internal thermal gradients.

In practical application, the parallel neighbouring tubes, arranged in a closely adjacent-contacting relation form between them a prismatic space of a generally triangular cross-section. Since the intensive cooling effect of the tubes is practically uniform around their perimeters, the mass of the triangular prism of the slag deposited between the tubes is exposed to a highly non-uniform cooling, causing high internal thermal gradients resulting in excessive internal stresses. Amplified by rapid changes of furnace interior temperature, the protective refractory or slag layer cracks and spalls, exposing the unprotected hot face of the tubes of the coil to seaparate or combined mechanical, electrical and thermal damage to the hot face of the tubes of the element.

Another known design of tubular water cooled element consists of plurality of, in one plane to each other parallel tubes arranged with a space between neighbouring tubes and interconnected with flat bar spacers on the cold face of the cooling element (German Offenlegungsschrift DE 29 37 038 A 1). This type of water cooled element also has the disadvantage of being unable to permanently and satisfactorily retain the initially deposited protective refractory or splashed on slag layer. Cracking and spalling of the protective refractory or solidified slag layer is initiated in principle by excessive thermal expansion of the interconnecting flat bar spacers causing separating forces between the deposited refractory or slag and the parallel tubes arranged in one plane.

All previously discussed known designs of water cooled elements have a significant common disadvantage, in addition to those described:

flow of liquid coolant such as water is constant through all phase-periods of the furnace operating cycle, although thermal loading of elements hot face varies from 0 to maximum.

SUMMARY OF THE INVENTION

It is an object of the present invention to provide a forced cooling, metallic, refractory coated, high strength, modular, extreme heat withstanding, low thermal inertia, long life lining element for partial or total lining of a metallurgical furnace above the hot metal and slag levels, in particular scrap and/or sponge iron melting Electric Arc and Plasma Arc Furnaces.

Another object of the invention is to provide a forced cooling lining element providing positive and permanent retention of a desired uniform thickness of initially deposited refractory material and/or by splashing deposited slag layer, by highly uniform automatically controlled economical heat extraction from the pipes, of the elements for effective prevention of cracking and spalling of the protective refractory and/or slag layer from the hot face of the element.

Another object of the invention is to provide an improved forced cooling lining element of uncomplicated modular light weight design with an efficient protective refractory and/or slag anchoring system and high operating pressure abilities, permitting its use as a boiler type high pressure unit for evaporative cooling system, allowing economic and efficient heat recuperation.

A further object of the invention is to provide an improved forced cooling lining element with an easy to fabricate construction, adaptable as to shape and size for maximum advantageous use as a long life element for lining of metallurgical furnaces of any size.

It is yet another object of this invention to provide a forced cooling element of the above described type having an automatic liquid coolant flow control. It is still another object of the invention to provide an automatic flow control device for a forced cooling element.

It is yet another object of the invention to provide a metallurgical furnace having a metallic lining comprising at least one panel formed from an element of the above defined class.

It is yet another object of the invention to provide a metallurgical furnace having means to provide a variable controlled flow component in a coolant liquid for cooling parts of said furnace.

The present invention overcomes the previously discussed advantages of the prior art known designs and constructions by providing a forced cooling, extreme heat withstanding lining element for metallurgical furnaces above the hot metal and slag levels, comprising at least three pipes, arranged in a generally parallel, eccentrically spaced noncontacting relation, spacers between said pipes, and neighbouring noncontacting pipes being interconnected to define a continuous passage for flow of cooling liquid.

The pipes are suitably seamless, heavy wall boiler type pipes, and the neighbouring noncontacting pipes are interconnected by welded mitres or mitres and elbows to create a series or series-parallel structure.

The pipes are more especially, of circular cross-section.

In a particular embodiment the forced cooling lining element is further characterized by the fact, that the hot face of the element pipes is provided with a protective refractory and/or slag layer anchoring system, comprising a multitude of protuberances. Suitably, the protuberances may be arranged intermittently and diagonally to the pipes and may be of circular cross-section.

In particular the pipes are of circular cross-section and the protuberances are coaxial with the circumferential contour of the pipes.

The spacer elements are in particular, of generally circular cross-section and are disposed between the neighbouring eccentrically spaced pipes on the cold face of the element; the pipes being joined to the spacer elements by intermittent and alternating welds. The cavities defined between the eccentrically spaced apart noncontacting pipes, and the spacer elements at the cold face facilitates good retention of pre-applied refractory or splashed on slag.

The element typically includes a plurality of uncoiled eccentrically spaced apart pipes significantly greater than three, and said element forms a generally rectangular panel, having a generally central panel part composed of pipes in parallel in a tight zig-zag configuration, the internal passages of said pipes defining a flow path for liquid coolant significantly longer than the length of the central portion; and a perimeter portion comprising pipes in series with the pipes of the central portion. The perimeter portion may include pipes which are parallel with each other in a serpentine configuration. The central portion may in particular include a first set of aligned pipes having their axes in a first same plane, and a second set of aligned pipes having their axes in a second same plane, a pipe of the second set being disposed between adjacent pipes of the first set.

Thus the pipes of the second set are eccentrically set to the pipes of the first set.

The eccentricity of the pipes and the alignment of the pipes in the respective sets produces a serpentine profile on the hot face of the central portion.

According to another embodiment of the invention the eccentrically spaced pipes of the element may be connected as for liquid coolant flow in series, parallel or series-parallel flow pattern, depending upon the desired rate of heat extraction for a specific area of the element, eccentrically spaced pipes being preferably joined by welded mitres and elbows.

According to another embodiment of the invention, the main metallic components of the element are made advantageously from oxidation resisting, seamless, heavy wall boiler type pipes, which have highly efficient heat transfer characteristics, as well as more than adequate mechanical strength, exceptionally suitable to withstand external mechanical impacts and rapid, wide range temperature changes occuring during normal furnace operating cycles.

According to another embodiment of the invention the high mechanical strength of the element as a structural unit is realized by advantageous arrangement of the pipe serpentine structural pattern to create a partial or total perimetric frame of the element, with the pipe zig-zag structural pattern arranged inside of this frame. This pipe structural pattern arrangement together with reinforcing flat plate strips welded to the cold face of the element provides additional, more than adequate mechanical strength. Although having more than adequate mechanical strength, the structure of the element has the vitally important ability of limited thermal flexibility, due to the fact that only each second eccentrically spaced pipe is interconnected by the reinforcing flat plate strips. Furthermore, intermittent and alternating welds between eccentrically spaced pipes and circular spacers complement the necessary limited mechanical flexibility of the element.

In accordance with another embodiment of the invention, the most uniform and effective heat extraction from the element is achieved by directing the unheated liquid coolant, such as water, in the first instance to the element areas with the highest thermal loading, one possible flow pattern being as follows:

after entering into the element internal passages, via a single entry port, the liquid coolant is immediately directed in the shortest possible way to the elements lowest passage which is closest to the molten metal and slag levels; from there the coolant is directed through the remaining part of the perimetric frame serpentine passages to the lowest part of the zig-zag structural pattern, and after flowing upwardly through this part of the element, the heated liquid coolant exits the element internal passages through a single discharge port.

In accordance with another embodiment of the invention, the modular forced cooling lining element is attached to an electric arc furnace shell primarily by a single or doubled circular segment shaped flange, provided with two openings for example, circular openings for wedged pin connection. For additional locating stability of the attachment, the element is provided with brackets welded to the reinforcing flat plate strips on the cold face of the element.

Furthermore, the present invention is based on experimentally obtained values of physical properties and parameters of the slag in metallurgical furnaces, requiring specific eccentrically spaced main pipes, as well as proper shape, positioning and spacing between components of the protective refractory and/or slag layer anchoring system for satisfactory, permanent and uniform adhesion of the protective refractory and/or slag layer to the anchoring system through all periods of the furnace operating cycle. Moreover, with a diagonal arrangement of the hot face protuberances and eccentrically spaced pipes, the gravitational downward flow of the still liquid slag is retarded being forced into an expanded, serpentine and zig-zag, flow pattern on the hot face of the element.

According to another embodiment of the invention, the slag deposited on the hot face of the element by solidifying of the liquid slag splashed on the hot face, creates a mechanical protection as well as thermal and electrical insulation of the elements metallic pipe structure.

In accordance with another embodiment of the invention the proper instant heat extraction capacity is continuously controlled by an integrally arranged automatic liquid coolant flow control device, which controls the discharge flow of the coolant, depending upon instant thermal loading of the hot face of the element. The low pressure drop automatic flow control device, preferably a thermostat, controls the flow of the liquid coolant through the element pipe passages depending directly upon the predetermined temperature of the liquid coolant at the discharge port of the element. The liquid coolant flow controlling bimetallic or expansion thermostat is together with the safety relief valve advantageously arranged in one functional unit, located as close as possible to the discharge port of the element.

Consequently, the protective slag layer has, during a majority of the time of the furnace operating cycle, an optimal temperature, assuring its proper functioning with the optimal coolant flow and therefore low overall liquid coolant consumption. The thermal insulating feature of the slag layer on the hot face of the element protects the element from undesirable overheating, while the electric insulating character minimizes the possibility of structure damage caused by infrequent but possible electric arc discharges between conductive metallic charge in the furnace and the metallic pipes of the element.

The integral automatic flow controlling thermostat, for continuous controlling of the forced flow of the liquid coolant depending directly upon instant thermal loading of the element hot face has several additional highly beneficial features. These features are:

(i) reduction of total energy consumption by the furnace. Because the hot face of the element is fully thermally loaded only during approximately 50% of the total tap-to-tap time, automatic temperature dependant liquid coolant flow control also results in a lower heat extraction capacity of the element, with consequent lower total energy consumption by the furnace.

(ii) reduction of cracking and spalling of the slag layer. Besides lower consumption of the liquid coolant, automatically controlled reduction of the liquid coolant flow, directly related to the lower thermal loading of the hot face of the element is minimizing cracking and spalling of the slag layer from the element hot face.

(iii) automatic balancing of aggregate of elements. Due to automatic, temperature depending control of the heat extraction of each individual element, each element automatically adjusts its heat extraction depending on its position in "hot" or "cold" spot in the furnace. This feature of the element in accordance with the invention reduces the possibility of incorrect manual adjustment of the liquid coolant flow in individual elements.

(iv) extension of the service life of the elements. Because of the temperature dependant automatic flow control of the liquid coolant through the element pipe passages, the range of the temperature variations of the liquid coolant discharged from the element is narrower. Since the internal stresses in the metallic wall structure of the pipes are directly proportional to the difference between outside and inside temperatures of the pipe wall, more uniform temperature of the liquid coolant in the elements passages reduces internal stresses in the pipe parent material as well as in the welded joints. Lower internal material stresses then consequently result in longer service of the entire metallic structure of the element.

DETAILED DESCRIPTION OF PREFERRED EMBODIMENTS WITH REFERENCE TO THE DRAWINGS

Figure 1:
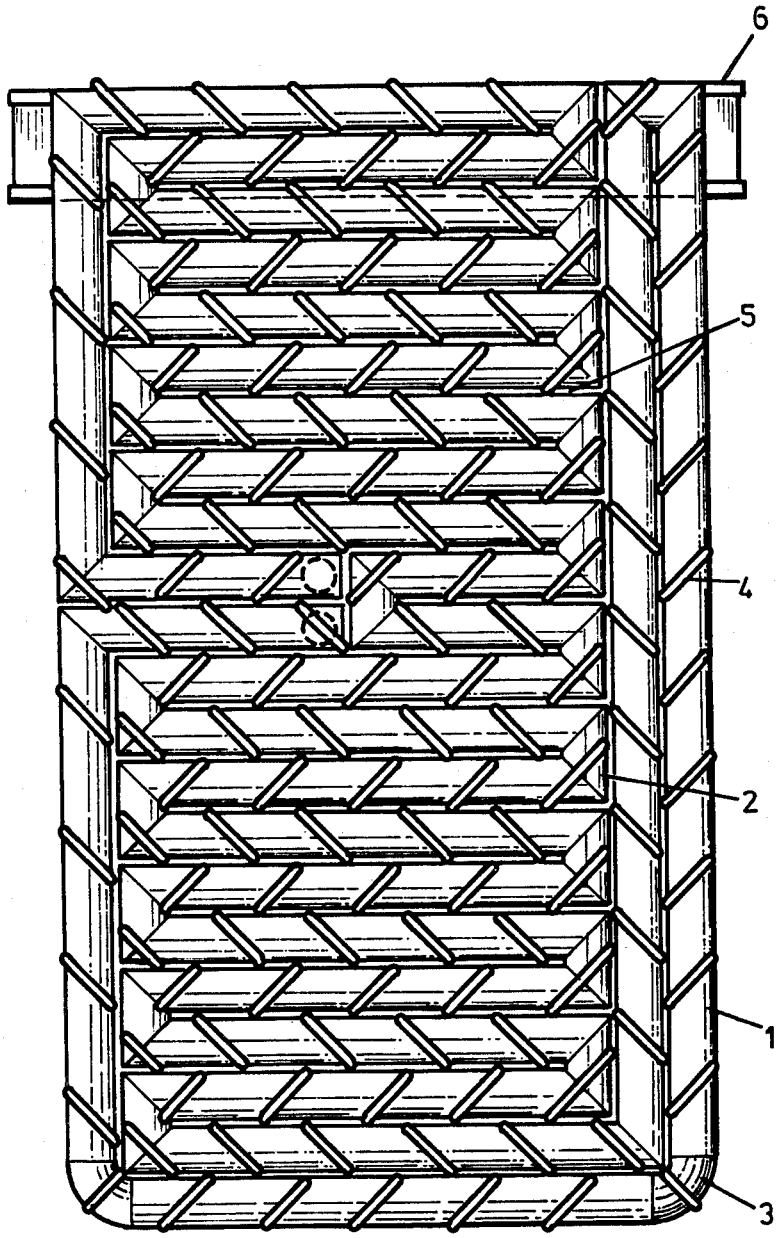
FIG. 1 is a front plan view of the hot face of a forced cooling lining element in accordance with the invention and illustrating the interconnection of the pipes by welded mitres and elbows to create a zig-zag serpentine structural pattern.

Referring to the FIG. 1 there is illustrated the front plan view of the hot face of a forced cooling lining element of the invention which includes a plurality of seamless pipes 1, arranged in generally parallel eccentrically spaced, noncontacting relation. The neighbouring pipes 1 are interconnected by mitres 2 and elbows 3, to create a series and series-parallel serpentine and zig-zag structural pattern. The spaces between eccentrically arranged pipes 1, serving as a prime anchoring system for protective refractory and/or slag layer, are created by spacers 5, having circular cross-section. Connection between pipes 1 and spacers 5 is made preferably by noncontinuous, intermittent and alternating welds. For mechanical protection of pipes 1, as well as the secondary anchoring system for refractory and/or slag protective layer, pipes 1 are provided on their hot face with coaxially and diagonally to pipes 1 arranged intermittent protuberances 4 having a circular cross-section. Protuberances 4 are preferably welded to the pipes 1. The double flanged hanging segment 6 is arranged at the top of the element.

Figure 2A:
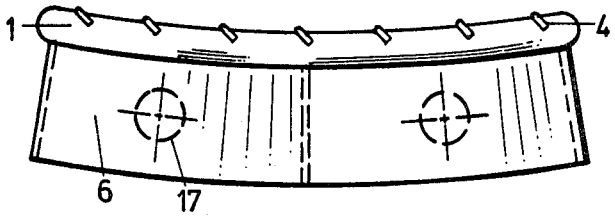
FIG. 2*a* is a top plan view of the attachment-hanging structure flanges of the element of FIG. 1 of the invention.

FIG. 2*a* is a top plan view of the forced cooling lining element of the invention, showing the top double flanged hanging attachment 6, welded to the structural pattern of pipes 1 and having openings 17 in the lower flange segment for wedged attachment of the element to the furnace shell supporting construction.

Figure 2B:
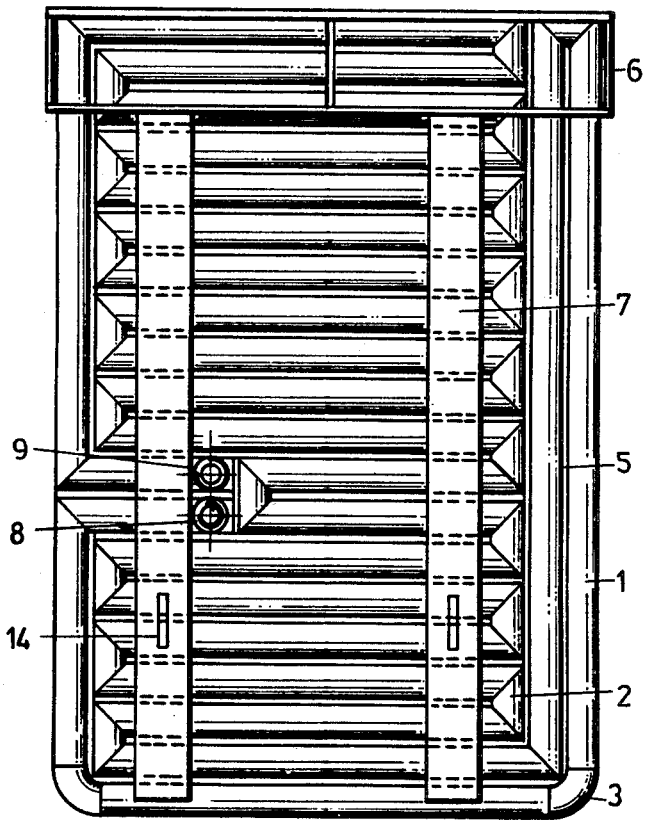
FIG. 2*b* is a rear plan view of the cold face of the element of FIG. 1 showing reinforcing strips and attachment structure.

FIG. 2*b* is a rear plan view of the cold face of the element of FIG. 1 showing the pipes 1 connected by mitres 2 and elbows 3 as well as spacing of the pipes 1 with the spacers 5. Pipes 1 are on the cold face of the element provided with an entry port 8 and an exit port 9, both generally perpendicular to pipes 1, and allowing supply and discharge of the pressurized liquid coolant to and from the series or series-parallel internal passages of the pipes 1. During operation the liquid coolant circulates at high velocities and high pressures through the pipes 1 from the entry port 8 to the exit port 9. The double flanged hanging attachment segment 6 is welded to the top of the element consisting of pipes 1 and welded for additional strength to the flat plate strips 7. The serpentine and zig-zag structural pattern of the pipes 1 is on their cold face reinforced by vertical flat plate strips 7, welded to the pipes 1. The flat plate strips 7 are provided with welded on brackets 14 for additional attachment stability when wedged against the furnace shell supporting structure.

Figure 3A:
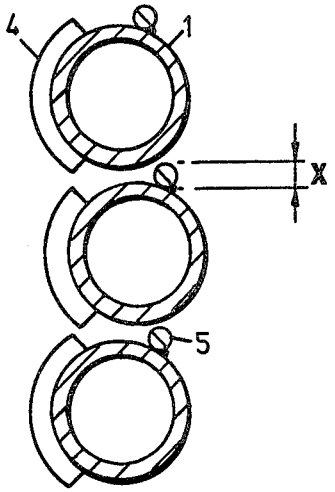
FIG. 3*a* is a partial side cross-sectional view of a forced cooling lining element of the invention illustrating the arrangement of the eccentrically spaced pipes, with circular spacers as well as coaxially to the pipes arranged components of a protective anchoring system.
Figure 3C:
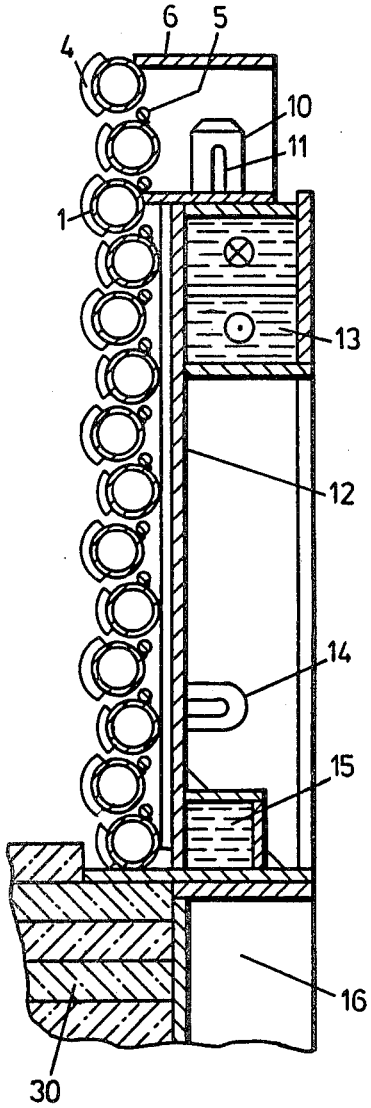
FIG. 3*c* is a side cross-sectional view of one of several possible arrangements for attaching hanging a forced cooling lining element to the furnace shell structure.
Figure 3B:
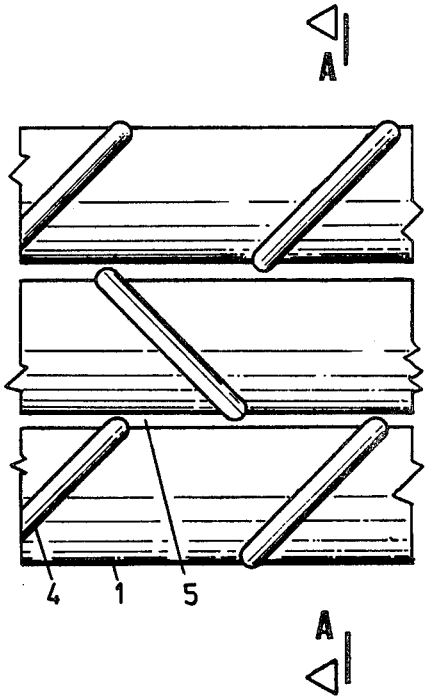
FIG. 3*b* is a partial front plan view of the hot face of the element of FIG. 3*a* showing the diagonal arrangement of the protective anchoring system of circular cross-section.

FIG. 3*a* is a partial side cross-sectional view on line A—A of FIG. 3*b*, illustrating the eccentricity of the eccentrically arranged pipes 1. Separated noncontacting spacing of the pipes 1 is created by the spacers 5 of diameter x, connecting the eccentrically spaced pipes 1 on their cold face. Also illustrated is the coaxial arrangement of the protuberances 4 of circular cross-section on the pipes 1.

FIG. 3*b* is a partial front view of the pipes 1, illustrating the diagonal arrangement of the circular protuberances 4 with respect to the pipes 1, spaced by circular cross-section spacers 5.

FIG. 3*c* is a cross-sectional view of the forced cooling lining element when attached to a furnace shell supporting structure. The element consisting of pipes 1, spacers 5 and coaxial and diagonal protuberances 4 is attached-hanged to the split shell top section supporting structure 12 by sliding of the two openings 17 (FIG. 2*a*) over the two sloted pins 10 of the shell supporting structure 12. The attaching of the element's double flanged hanging attachment 6 to the shell supporting structure 12 is secured by the wedge 11. Additional stability of the attaching of the element to the shell structure is provided by wedging of the bracket 14 to the shell structure. The shell top section is provided with manifolds 13 for supply and discharge of the liquid coolant to and from the element, as well as cooling compartment 15 of the bottom flange of the shell top section. The entire top section 12 of the shell rests on the shell middle or bottom section 16, lined with standard refractory 30.

Figure 4A:
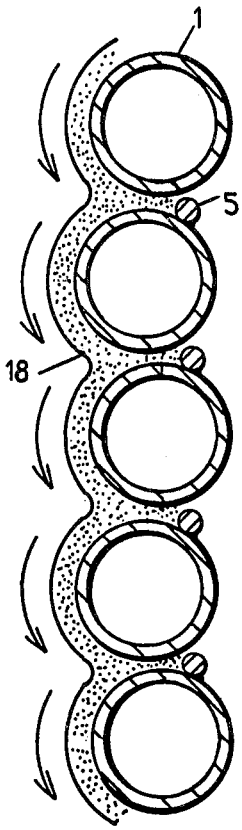
FIG. 4*a* is a partial side cross-sectional view of a forced cooling lining element of the invention, illustrating the downward serpentine of the still liquid slag flow pattern.

FIG. 4*a* is a partial cross-sectional side view of an element consisting primarily of pipes 1 and spacers 5, and illustrating the retarded downward serpentine flow of the still liquid slag 18, allowing slag longer time for its eventual solidification.

Figure 4B:
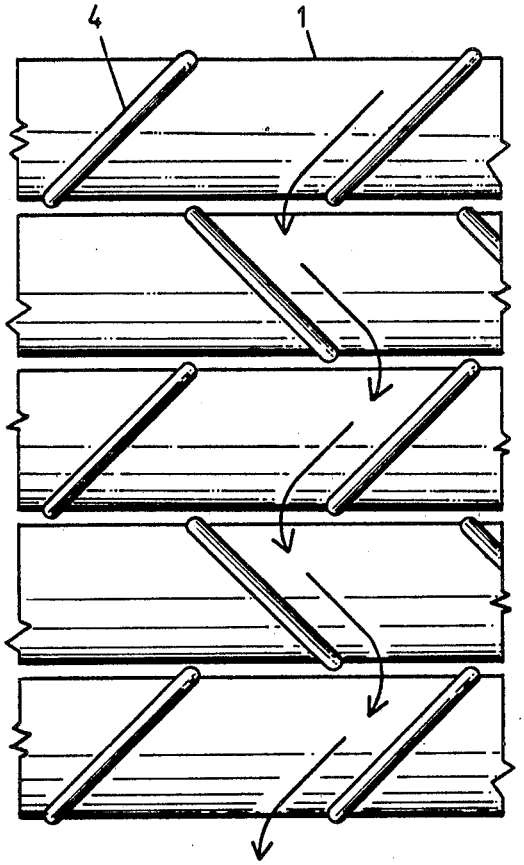
FIG. 4*b* is a partial front plan view of the forced cooling lining element of FIG. 4*a* of the invention, showing the downward zig-zag still liquid slag flow pattern.

FIG. 4*b* is a partial front plan view of the element consisting primarily of pipes 1 and circular protuberances 4, illustrating the additional slowdown of the downward zig-zag flow pattern of the still liquid slag due to the diagonal arrangement of the circular protuberances 4 on the pipes 1.

Figure 5:
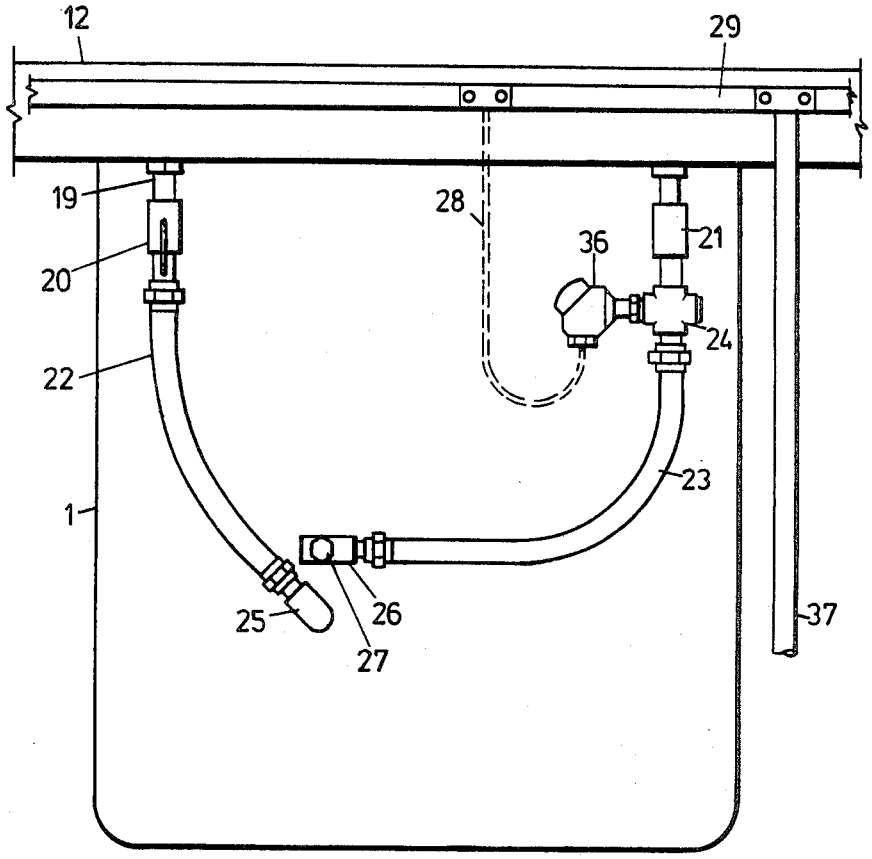
FIG. 5 illustrates a typical arrangment of the piping controlling and monitoring system for supply and discharge of the liquid coolant into and out of a forced cooling lining element of the invention.

FIG. 5 is a typical arrangement of a piping, controlling and monitoring system. The element consisting of pipes 1 is attached to the top section of the shell 12. The liquid coolant is supplied to the element from the main manifold of the shell via supply outlet 19, supply shut-off ball-valve 20, supply flexible hose 22 and elbow with quick connect 25 into the entry port 8 (FIG. 2*b*). From the exit port 9 (FIG. 2*b*) the liquid coolant is discharged via automatic flow control device 26, which is equipped with safety relief valve 27. Discharging of the liquid coolant continues via flexible discharge hose 23 with quick connects, into the cross fitting 24 from which the liquid coolant flows via discharge shut-off ball-valve 21 into the outlet of the main discharge manifold of the shell 12 supporting structure. A temperature monitoring device 36 is inserted into the cross fitting 24. A flexible electric conduit with electrical sensing wiring 28 is connected to the solid circumferential conduit on the shell supporting structure. Connection to the monitoring instruments is made via sensing wiring in the conduit 37.

Figure 6:
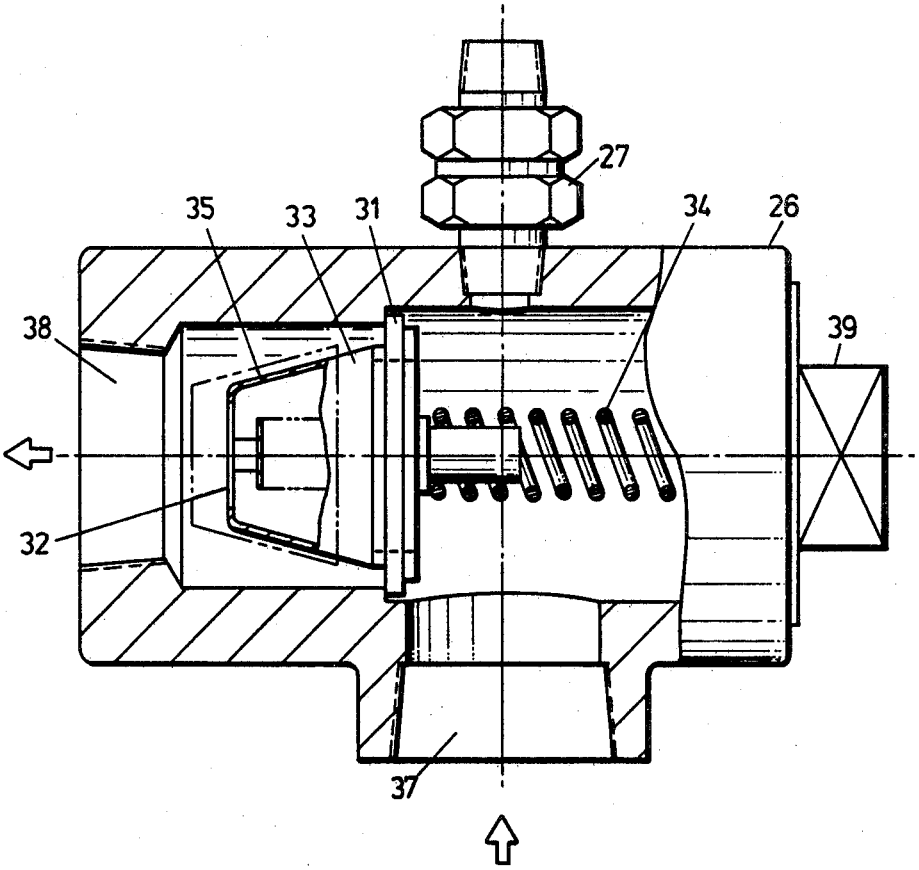
FIG. 6 is a partial cross-sectional side view of an automatic flow control device according to the present invention.

FIG. 6 is partial cross-sectional side view of the automatic flow control device 26. This automatic flow control device consists of main body 26, having an entry port 37 and an exit port 38, and of an automatic fluid flow control thermostatic valve 31, which is actuated by bimetallic or expansion material for opening when a high predetermined temperature is reached and with spring force for closing when a low predetermined temperature is reached. The valve 31 is permanently secured in the body 26 by spring 34 and plug 39. For protection of the element against excessive pressure the automatic flow control device 26 is equipped with a pressure relief valve 27. The discharge flow liquid coolant from exit port 9 enters entry port 37 of the automatic flow control device 26. Before reaching the predetermined high temperature, the controlling cone 35, having permanent calibrated flow through passage 32, is in a closed position, closing the by-pass 33. At the low predetermined temperature the discharge flow of the coolant flows through the flow through passage 32 and through the exit port 38 out of the automatic flow control device 26. When the temperature of the discharged liquid coolant reaches the high predetermined temperature, this high temperature actuates the automatic fluid flow control thermostatic valve 31, which repositions cone 35 so that the controlled passage 33 opens. The discharged liquid coolant now flows through the controlled passsage 33 and permanent calibrated flow through passage 32 of the cone 35. The flow volume of the liquid coolant discharged from the element is herewith controlled in the predetermined range, directly depending upon its temperature.

I claim:

1. A forced cooling panel for lining a metallurgical furnace comprising:

a lining element having a hot face adapted to face a furnace interior and a cold face adapted to face a furnace wall, said element comprising a plurality of at least three metal pipes disposed in generally parallel, eccentrically spaced apart noncontacting relation, said pipes being interconnected to define a continuous passage for flow of cooling liquid, spacer elements disposed between adjacent noncontacting eccentrically spaced pipes on said cold face, and a plurality of spaced apart protuberances projecting from said hot face, said protuberances providing an anchoring system for preapplied refractory material or splashed on solidified slag, said protuberances extending generally diagonally of said pipes and defining a continuous flowpath for retarded flow of liquid slag effective for flow of liquid slag into the spaces between adjacent noncontacting pipes.

2. A forced cooling panel for lining a metallurgical furnace comprising:

a lining element having a hot face adapted to face a furnace interior and a cold face adapted to face a furnace wall, said element comprising a plurality of at least three metal pipes disposed in generally parallel, eccentrically spaced apart non-contacting relation, said pipes being interconnected to define a continuous passage for flow of cooling liquid, spacer elements disposed between adjacent eccentrically spaced pipes on said cold face, and a plurality of spaced apart protuberances projecting from said hot face, said protuberances providing an anchoring system for preapplied refractory material or splashed on solidified slag, said protuberances extending generally diagonally of said pipes, and being of generally circular cross-section and welded to said pipes, the protuberances on adjacent eccentrically spaced pipes extending in opposed diagonal directions thereby defining a zig-zag flow path for liquid slag.

3. A panel according to claim 1, wherein said spacer elements are of generally circular cross-section, adjacent eccentrically spaced apart pipes and the spacer elements being joined together by intermittent and alternating welds.

4. A forced cooling metallic lining panel for partial or total lining of a metallurgical furnace, especially a steel scrap and prereduced sponge iron melting Electric Arc or Plasma Arc Furnace, comprising:

(a) a forced cooling lining element having a hot face and a cold face and comprising at least three seamless boiler type pipes arranged in generally parallel, eccentrically spaced, non-contacting relation;

(b) said eccentrically spaced pipes of the element being arranged in a non helical arrangement;

(c) said eccentrically spaced neighbouring pipes of the element being interconnected by welded mitres and elbows in series and series-parallel internal passages;

(d) said eccentrically spaced neighbouring pipes of the element being separated from each other with circular spacers, located between pipes on said cold face;

(e) said eccentrically spaced neighbouring pipes of the element and the separating circular spacers being joined together by intermittent and alternating welds;

(f) said eccentrically spaced neighbouring pipes of the element being mechanically protected by a multitude of spaced apart protuberances disposed diagonally of the pipes of circular cross-section, the protuberances being welded to the individual pipes on said hot face;

(g) said protuberances defining an anchoring system for initially deposited refractory material or splashed on solidified slag, and (h) the protuberances on adjacent eccentrically spaced pipes extending in opposed diagonal directions thereby defining a zig-zag flow path for liquid slag.

5. A forced cooling panel of claim 4, further including:

(a) a double flanged attachment structure adapted for attachment of the element to a shell supporting structure of a furnace;

(b) said double flange attachment structure being permanently connected to the eccentrically spaced pipes of the element;

(c) an element reinforcing structure comprising flat plate strips;

(d) said double flange attachment structure being permanently connected to said reinforcing structure;

(e) said reinforcing structure being permanently connected alternate eccentrically spaced pipes of the element to provide flexibility in the element;

(f) said reinforcing structure being provided with brackets for additional stability for attachment of the element to a furnace shell supporting structure.

6. A panel according to claim 5, wherein said double flange attachment structure is welded to said pipes and to said reinforcing structure; said reinforcing structure being welded to said alternate pipes; and said brackets being welded to said reinforcing structure.

7. A panel according to claim 4, further including:

(a) an entry port and an exit port in said element allowing supply and discharge of pressurized liquid coolant, to and from the internal passages of the element;

(b) internal passages providing for circulation of liquid coolant at variable high velocities and high pressures flow through the series and series-parallel internal passages;

(c) the circulation path being immediately after entrance through the entry port, directed along the shortest possible route to the lowest internal passage of the element adapted to be closest to the molten metal and slag levels, and further directed through the remaining part of the perimetric frame serpentine passages to the lowest part of the zig-zag passages and then being directed upwardly through the zig-zag passages to an upper portion from which point the passages discharge through the exit port.

8. A panel according to claim 4, further including:

(a) an automatic flow control device for variable controlled flow of a liquid coolant;

(b) said automatic flow control device being adapted to control the variable flow component of the liquid coolant through the internal passages at a point adjacent to the exit port of the element;

(c) said element having a predetermined size to provide in conjunction with the lowest desired temperature of coolant water at the exit port, a constant uncontrolled basic flow in the liquid coolant.

9. A forced cooling metallic lining panel for partial or total lining of a metallurgical furnace, especially a steel scrap and prereduced sponge iron melting Electric Arc or Plasma Arc Furnace, comprising:

(a) a forced cooling lining element having a hot face and a cold face and comprising at least three seamless boiler type pipes arranged in generally parallel, eccentrically spaced, non-contacting relation;

(b) said eccentrically spaced pipes of the element being arranged in a non helical arrangement;

(c) said eccentrically spaced neighbouring pipes of the element being interconnected by welded miters and elbows in series and series-parallel internal passages;

(d) said eccentrically spaced neighbouring pipes of the element being separated from each other with circular spacers, located between pipes on said cold face;

(e) said eccentrically spaced neighbouring pipes of the element and the separating circular spacers being joined together by intermittent and alternating welds;

(f) said eccentrically spaced neighbouring pipes of the element being mechanically protected by a multitude of spaced apart protuberances disposed diagonally of the pipes of circular cross-section, the protuberances being welded to the individual pipes on said hot face;

(g) said protuberances defining an anchoring system for initially deposited refractory material or splashed on solidified slag, (h) an automatic flow control device for variable controlled flow of a liquid coolant;

(i) said automatic flow control device being adapted to control the variable flow component of the liquid coolant through the internal passages at a point adjacent to the exit port of the element;

(j) said element having a predetermined size to provide in conjunction with the lowest desired temperature of coolant liquid at the exit port, a constant uncontrolled basic flow in the liquid coolant;

(k) said automatic flow control device being a bimetallic or expansion material actuated automatic fluid flow control thermostat;

(l) said automatic fluid flow control thermostat being an integral and constituent component of the element;

(m) said automatic fluid flow control thermostat having a permanent, uncontrolled and calibrated direct flow-through passage opening for uncontrolled basic flow of liquid coolant through the element;

(n) said automatic fluid flow control thermostat having a variable by-pass passage for control of the controlled variable flow of the liquid coolant through the element;

(o) said thermostat being directly controllable by the temperature of the discharge cooling liquid flowing from the element through said direct flow-through passage;

(p) said variable by-pass passage when fully open being capable of providing supplementary flow of the discharge coolant for assuring safe and adequate heat extraction from the element at maximum thermal loading of the hot face of the element; and (q) said thermostat being disposed together with a coolant discharge circuit safety relief valve, in one functional unit, the safety relief valve being hydraulically connected between said exit port and said thermostat.

10. In a metallurgical furnace having a metallic lining comprising at least one lining panel, the improvement wherein said panel is as defined in claim 1.

11. In a metallurgical furnace having a metallic lining comprising at least one lining panel, the improvement wherein said panel is as defined in claim 4.

12. A panel according to claim 1, further including an automatic flow control device adapted to provide a variable controlled flow component of liquid coolant in said element.

13. A panel according to claim 12, wherein said device is disposed adjacent an exit port of said internal passages, to control said variable flow component.

14. In a metallurgical furnace having a metallic lining comprising at least one lining panel having internal passages for flow of a coolant liquid, the improvement wherein said panel includes an automatic flow control device adapted to provide a variable controlled flow component in said coolant liquid, said automatic flow control device being adapted to control the variable flow component of the liquid coolant through the internal passages at a point adjacent to an exit port of the panel;

the passages having a predetermined size to provide in conjunction with the lowest desired temperature of coolant liquid at the exit port, a constant uncontrolled basic flow in the liquid coolant, said automatic flow control device being an automatic fluid flow control thermostat having a permanent, uncontrolled and calibrated direct flow-through passage opening for uncontrolled basic flow of liquid coolant through the panel passages;

said automatic fluid flow control thermostat having a variable by-pass passage for control of the controlled variable flow of the liquid coolant through the panel passages;

said thermostat being directly controllable by the temperature of the discharge cooling liquid flowing from the panel through said direct flow-through passage; and said variable by-pass passage when fully open being capable of providing supplementary flow of the discharge coolant for assuring safe and adequate heat extraction from the panel at maximum thermal loading of a hot face of the panel.

15. A furnace according to claim 14, wherein said thermostat is a bimetallic or expansion material actuated thermostat.

16. A furnace according to claim 14, wherein said thermostat is an integral and constituent part of said panel.

17. A furnace according to claim 14, wherein said thermostat is disposed together with a coolant discharge circuit safety relief valve, in one functional unit, the safety relief valve being hydraulically connected between said exit port and said thermostat.

18. A panel according to claim 1, wherein said protuberances on adjacent eccentrically spaced pipes extend in opposed diagonal direction thereby defining a zig-zag flow path for liquid slag.

19. A panel according to claim 18, wherein said protuberances are of generally circular cross-section.

20. In a metallurgical furnace having a metallic lining comprising at least one lining panel, the improvement wherein said panel is as defined in claim 2.

21. A panel according to claim 2, further including an automatic flow control device adapted to provide a variable controlled flow component of liquid coolant in said element.

22. A panel according to claim 21, wherein said device is disposed adjacent an exit port of said internal passages, to control said variable flow component.

23. A panel according to claim 1, wherein said pipes are of generally circular cross-section.

* * * * *